US012270146B2

(12) United States Patent
Yi

(10) Patent No.: US 12,270,146 B2
(45) Date of Patent: Apr. 8, 2025

(54) GARMENT STEAMER WITH CLAMP

(71) Applicant: SHEN ZHEN RONE PHOENIX NEST DESIGN DEVELOPMENT CO., LTD, Shenzhen (CN)

(72) Inventor: YongJie Yi, Shenzhen (CN)

(73) Assignee: SHEN ZHEN RONE PHOENIX NEST DESIGN DEVELOPMENT CO., LTD, Shenzhen (CN)

( * ) Notice: Subject to any disclaimer, the term of this patent is extended or adjusted under 35 U.S.C. 154(b) by 0 days.

(21) Appl. No.: 18/228,717

(22) Filed: Aug. 1, 2023

(65) Prior Publication Data

US 2025/0043503 A1 Feb. 6, 2025

(51) Int. Cl.
*D06F 75/14* (2006.01)
*D06F 75/20* (2006.01)

(52) U.S. Cl.
CPC ..... *D06F 75/14* (2013.01); *D06F 75/20* (2013.01)

(58) Field of Classification Search
CPC ..... D06F 75/00; D06F 75/30; D06F 75/36
See application file for complete search history.

(56) References Cited

U.S. PATENT DOCUMENTS 4,739,151 A * 4/1988 Smal ..... A45D 1/06 132/118
7,730,895 B2 * 6/2010 Maddocks ..... A45D 1/06 132/224
9,580,861 B2 * 2/2017 Ford-Willcocks ..... D06F 75/34
2009/0301509 A1 * 12/2009 Leung ..... A45D 2/001 132/269

FOREIGN PATENT DOCUMENTS

CN 206736598 U * 12/2017
CN 207452527 U * 6/2018

* cited by examiner

*Primary Examiner* — Ismael Izaguirre
(74) *Attorney, Agent, or Firm* — Olive Law Group, PLLC

(57) ABSTRACT

A garment steamer with a clamp includes a garment steamer body provided with a handhold part and an ironing part. The ironing part is provided with several steam holes. The garment steamer also includes: a clamp with one end hinged on one end of the handhold part away from the ironing part through a hinge shaft. The clamp is provided with several through holes connected to the steam holes one by one. A locking structure with one part set on the handhold part and the other part set on the clamp. An elastic member set between the clamp and garment steamer body, and used to separate the clamp from the garment steamer body to form an angle when the locking structure is in unlocked state.

7 Claims, 3 Drawing Sheets

GARMENT STEAMER WITH CLAMP

FIELD OF THE INVENTION

The present invention relates to the garment steamer technology, and more particularly to a garment steamer with a clamp.

BACKGROUND OF THE INVENTION

The garment steamer is a machine used to iron hung clothes and fabrics. The garment steamer can continuously contact clothes and fabrics through hot water vapor generated internally in order to soften the fiber structure of clothes and fabrics. It can also be used to flatten clothes and fabrics through "pulling", "pressing", and "spraying", making them look intact and new. Garment steamers are divided into hand-hold, common and pressure-type ones. Handhold garment steamers are well-received in the market as it is easy to carry them during traveling due to their small sizes. However, existing garment steamers only have one ironing surface. When ironing some parts of clothes, such as edges, collars, cuffs, and ties, creases need to be handled and the clothes needs to be pulled with one hand to provide a certain support force before ironing, so the operation is inconvenient and an improvement is needed.

DESCRIPTION OF THE INVENTION

The present invention aims to provide a garment steamer with a clamp in response to the defects and shortcomings of the existing technology. The garment steamer body is hinged with a clamp that is provided with through holes, thus two ironing modes of the garment steamer can be selected. The use of the clamp allows clothes to be clamped between the garment steamer body and clamp, achieving the advantage of providing a support pressure for ironing clamped clothes.

In order to serve the above purposes, the technical scheme adopted by the present invention is: a garment steamer with a clamp, includes a garment steamer body; The garment steamer body is provided with a handhold part and an ironing part; The ironing part is provided with several steam holes; The garment steamer also includes: A clamp with one end hinged on one end of the handhold part away from the ironing part through a hinge shaft. The clamp is provided with several through holes connected to the steam holes one by one; A locking structure with one part set on the handhold part and the other part set on the clamp; And an elastic member set between the clamp and garment steamer body, and used to separate the clamp from the garment steamer body to form an angle when the locking structure is unlocked.

A first sliding slot is set on one side of the clamp near the garment steamer body, and a guide hole is set on the clamp that runs through the first sliding slot; The locking structure includes: an insertion part that is protrusively set on the handhold part and can be inserted into the first sliding slot—the side wall of the insertion part is provided with a snap-fit slot; A locking member that is slidably fit in the first sliding slot and can be snap-fitted to or separated from the snap-fit slot; And a toggle that is connected to the locking member at one end and can slide in the guide hole.

A second sliding slot is set on the side of the clamp away from the first sliding slot, the guide hole runs through the first sliding slot and second sliding slot, and the toggle can slide in the second sliding slot.

The locking member is provided with positioning protrusions on both sides of the bottom, and several positioning slots that can match the positioning protrusions are set at the bottom of the first sliding slot and on both sides of the guide hole.

A first fit slot is set on one side of the clamp near the garment steamer body and between the hinge shaft and first sliding slot, and a second fit slot opposite to the first fit slot is set on the handhold part; The elastic member is fixed at one end in the first fit slot and at the other end in the second fit slot and abuts against the top of the second fit slot.

A fixing column is set in the first fit slot, the elastic member is a spring, and one end of the spring is fit outside the fixing column and fixedly connected to the fixing column.

A fixing hole is set at the bottom of the locking member, and the toggle includes: A toggle board that is slidably assembled in the second sliding slot; And a toggle column that is integrally set on the toggle board and provided with the guide hole and fixing hole at one end.

The garment steamer body comprises a casing, a water box, a water pump and a heating element; The handhold part and the ironing part are both set on the casing, the heating element is set in the ironing part of the casing, and the steam outlet of the heating element is connected to the steam holes; The water box is set in the handhold part of the casing and the water pump is set in the casing and between the water box and heating element; The water pump is connected to the water box and heating element respectively through a water tube.

After adopting the above technical scheme, the beneficial effect of the present invention is: a garment steamer with a clamp, includes a garment steamer body, a clamp, a locking structure and an elastic member. The garment steamer body is provided with a handhold part and an ironing part; The ironing part is provided with several steam holes; One end of the clamp is hinged on one end of the handhold part that is away from the ironing part through a hinge shaft; The clamp is provided with several through holes connected to the steam holes one by one; One part of the locking structure is set on the handhold part and the other part is set on the clamp; The elastic member is set between the clamp and garment steamer body, and used to separate the clamp from the garment steamer body to form an angle when the locking structure is unlocked. The user can keep the clamp and garment steamer body in a clamping state through the locking structure, and then perform the ironing operation to serve the basic functions of the garment steamer. The user can unlock the clamp through the locking structure, and the elastic member can drive the clamp to turn and open relative to the garment steamer body through its own restoring force and then the clothes can be placed in the open angle space for clamping and ironing through the locking structure and clamp providing a support pressure. When clothes are clamped for ironing, the steam can penetrate them and disperse through the through holes of the clamp, avoiding steam escape from both sides. Therefore, the garment steamer is provided with two ironing modes for users' easy selection as required.

DESCRIPTION OF THE DRAWINGS

In order to provide a clearer description of the embodiments regarding the present invention or the technical scheme in the prior art, below is a brief introduction to the drawings required in the embodiment or prior art description. Obviously, the drawings in the following description only relate to some embodiments of the present invention. For ordinary technicians in this art, other drawings can be obtained based on these ones without providing any creative labor.

Figure 1:
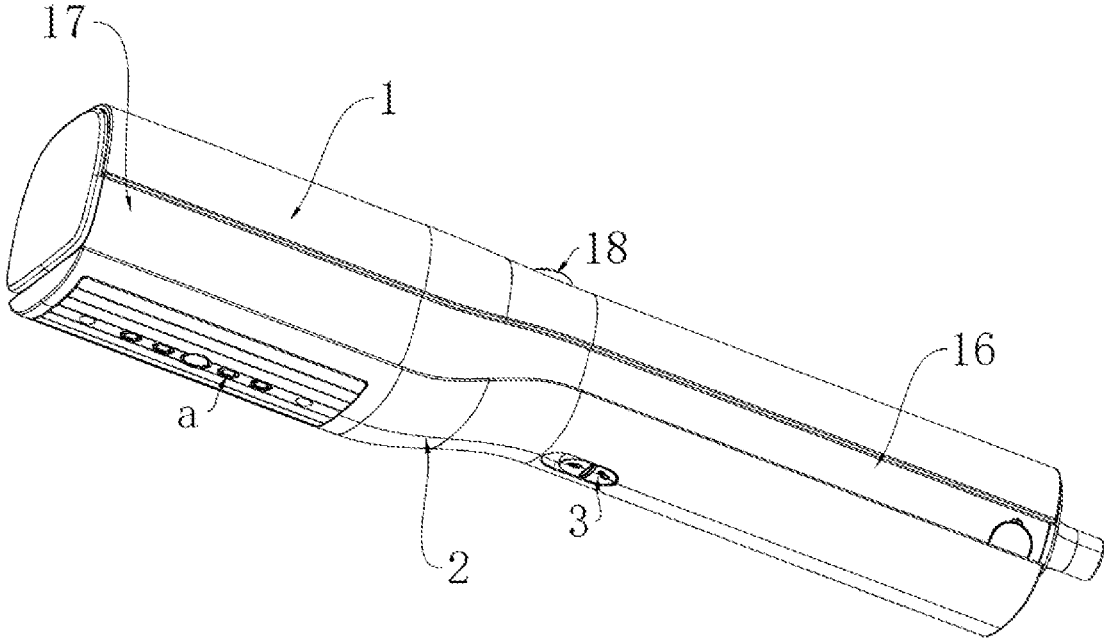
FIG. 1 shows a structural diagram of the present invention.

Drawing marks: 1, Garment steamer body; 2, Clamp; 3, Locking structure; 4, Elastic member; a, Through hole; b, Steam hole; c, First sliding slot; d, Guide hole; 5, Insertion part; 6, Locking member; 7, Toggle; e, Snap-fit slot; f, Second sliding slot; 8, Toggle board; 9, Toggle column; g, Positioning slot; 10, Positioning protrusion; h, First fit slot; i, Second fit slot; 11, Fixing column; 12, Casing; 13, Water box; 14, Water pump; 15, Heating element; 16, Handhold part; 17, Ironing part; j, Water inlet; 18, Control switch; 19, Hinge shaft.

DETAILED DESCRIPTION OF THE PREFERRED EMBODIMENTS

Below is a further description of the present invention based on the drawings.

This embodiment only shows an explanation of the present invention and is not a limitation to the present invention. Technicians in the art can make modifications to this embodiment as needed without making any creative contributions after reading this specification, which are always protected by the patent law as long as they are within the scope of the claims of the present invention.

As shown in FIG. 1-5, a garment steamer with a clamp includes a garment steamer body 1, a clamp 2, a locking structure 3 and an elastic member 4. The garment steamer body 1 is provided with a handhold part 16 and an ironing part 17; The ironing part 17 is provided with several steam holes b. One end of the clamp 2 is hinged on one end of the handhold part 16 that is away from the ironing part 17 through a hinge shaft 19. The clamp 2 is provided with several through holes a connected to the steam holes b one by one; One part of the locking structure 3 is set on the handhold part 16 and the other part is set on the clamp 2. The elastic member 4 is set between the clamp 2 and garment steamer body 1. The elastic member 4 is used to separate the clamp 2 from the garment steamer body 1 to form an angle when the locking structure 3 is unlocked. The first elastic member 4 can be a spring, a spring block, or a spring piece.

It should be noted that the clamp 2 is provided with through holes a connecting to the steam holes b one by one, so when the middle parts of clothes are to be ironed, the clamp 2 and the garment steamer body 1 can be kept in a clamping state through the locking structure 3, and then the ironing operation can be performed to serve the basic functions of the garment steamer. When the edges, collars, cuffs, or ties of the clothes are to be ironed, the clamp 2 can be unlocked through the locking structure 3, and the elastic member 4 can drive the clamp 2 to turn and open relative to the garment steamer body 1 through its own restoring force. The user can place the edges of the clothes in the open angle space, press the clamp 2 and garment steamer body 1, and then lock and fix them through the locking structure 3 to provide a support pressure for ironing the edges, collars, cuffs, or ties of the clothes. The clamp 2 is provided with through holes a that are connected to the steam holes b one by one. When clothes are clamped for ironing, the steam can penetrate them and disperse through the through holes a, avoiding steam escape from both sides. Therefore, the garment steamer is provided with two ironing modes for users' easy selection as required.

Figure 2:
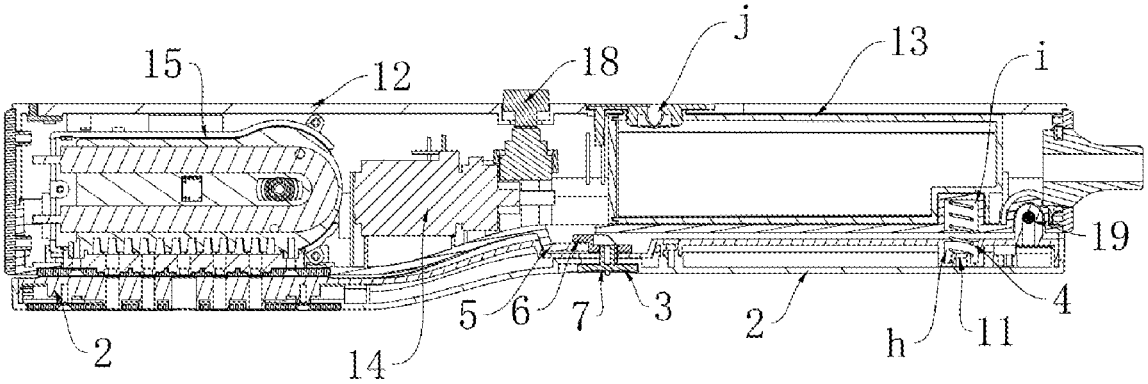
FIG. 2 shows a sectional view of the present invention.
Figure 3:
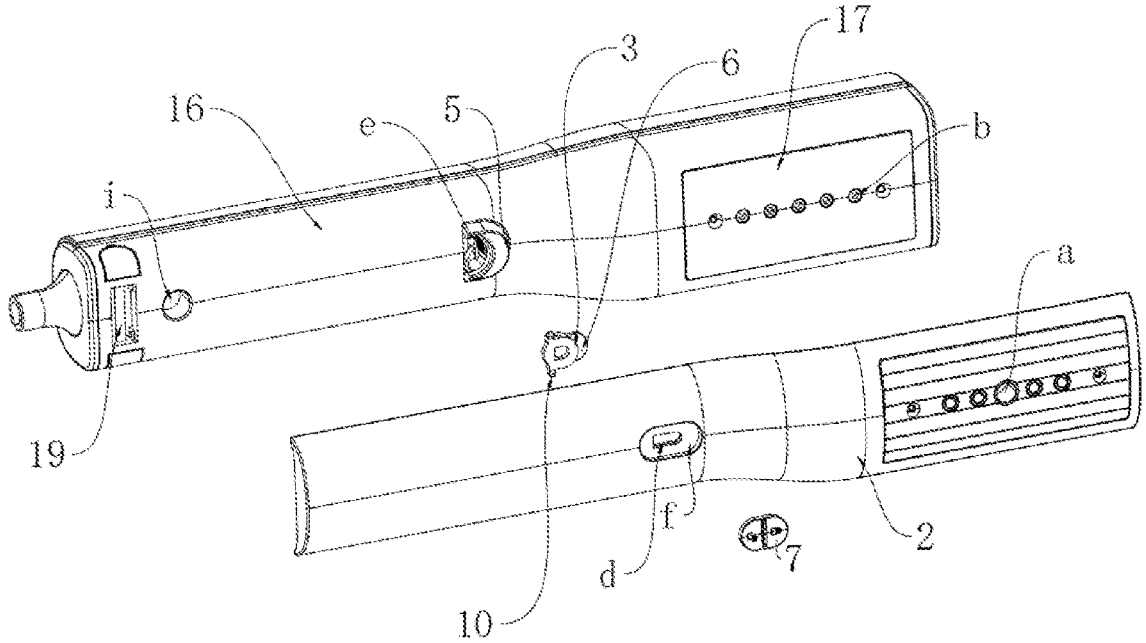
FIG. 3 shows the first explosion diagram of the present invention.
Figure 4:
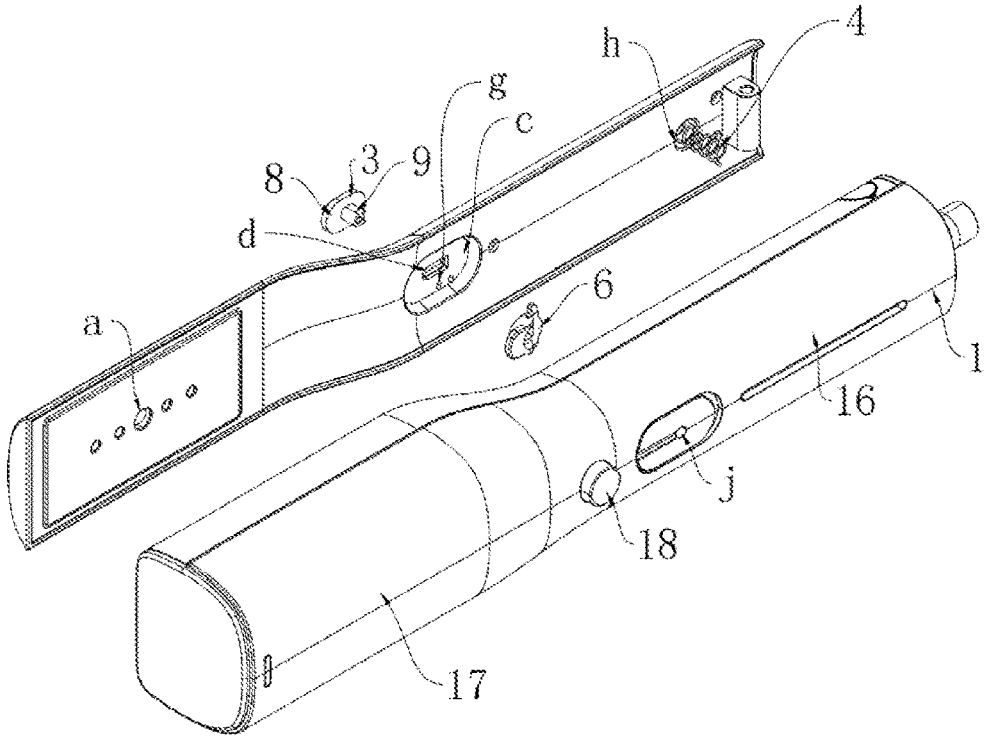
FIG. 4 shows the second explosion diagram of the present invention.

Preferably, in order to serve the locking or unlocking function of the locking structure 3 to the clamp 2, as shown in FIG. 2-4, the clamp 2 is provided with a first sliding slot c on one side near the garment steamer body 1, and furthermore the clamp 2 has a guide hole d that runs through the first sliding slot c. The locking structure 3 includes: an insertion part 5, a locking member 6, and a toggle 7. The insertion part 5 is protrusively set on the handhold part 16 and can be inserted into the first sliding slot c. The side wall of the insertion part 5 is provided with a snap-fit slot e. The locking member 6 is slidably fit in the first sliding slot c and can be snap-fitted to or separated from the snap-fit slot e. The cross-section of the locking member 6 is in a zigzag shape, and one end of the toggle 7 is connected to the locking member 6 and can slide in the guide hole d. In order to achieve an easy control of the locking or unlocking of the clamp 2 by the locking structure 3, a second sliding slot f is set on the side away from the first sliding slot c of the clamp 2, and the guide hole d runs through the first sliding slot c and second sliding slot f. The toggle 7 can slide in the second sliding slot f. In this embodiment, a fixing hole is set at the bottom of the locking member 6, and the toggle 7 includes a toggle board 8 and a toggle column 9. The toggle board 8 is slidably fit in the second sliding slot f. The toggle column 9 is integrally set on the toggle board 8 and provided with the guide hole d at one end for inserting into the fixing hole. The toggle column 9 is tightly matched with the fixing hole, and the toggle column 9 is integrally set with the toggle board 8.

When clothes are to be clamped for ironing, the user can slide the toggle board 8 to make the toggle column 9 drive the locking member 6 to slide in the first sliding slot c and separate the locking member 6 from the insertion slot to unlock the clamp 2. The elastic member 4 can drive the clamp 2 to turn and open relative to the garment steamer body 1 through its own restoring force. The user can place the edges of the clothes in the open angle space, press the clamp 2 and garment steamer body 1, and then slide the toggle board 8 to make the toggle column 9 drive the locking member 6 to slide and insert the locking member 6 in the insertion slot, thereby achieving clamping and fixation of the clothes by the clamp 2. At this time, the user can move the garment steamer to iron different parts of the clothes.

Preferably, as shown in FIGS. 3 and 4, the locking member 6 is provided with positioning protrusions 10 on both sides of the bottom, and several positioning slots g that can match the positioning protrusions 10 are set at the bottom of the first sliding slot c and on both sides of the guide hole d. In this embodiment, the positioning slots g are symmetrically set on both sides of the opening of the guide hole d. Each opening side of the positioning hole d is provided with two positioning slots g. The two positioning slots g are used for locking and unlocking of the locking structure 3, respectively.

Preferably, in order to limit the elastic member 4 between the clamp 2 and the garment steamer body 1, as shown in FIG. 2-4, a first fit slot h is set on the side of the clamp 2 near the garment steamer body 1 and between the hinge shaft 19 and first sliding slot c, and a second fit slot i opposite to the first fit slot h is set on the handhold part 16. One end of the elastic member 4 is fixed in the first fit slot h, and the other end is set in the second fit slot i and abuts against the top of the second fit slot i. In this embodiment, the first fit slot h is provided with a fixing column 11, the elastic member 4 is a spring, and one end of the spring is fit outside the fixing column 11 and fixedly connected to the fixing column 11. In some embodiments, both ends of the spring are fixedly connected to the bottom of the first fit slot h and the top of the second fit slot i. In other embodiments, the elastic member 4 is a torsion spring fit on the hinge shaft 19, and the two ends of the torsion spring abut the garment steamer body 1 and clamp 2, respectively.

Figure 5:
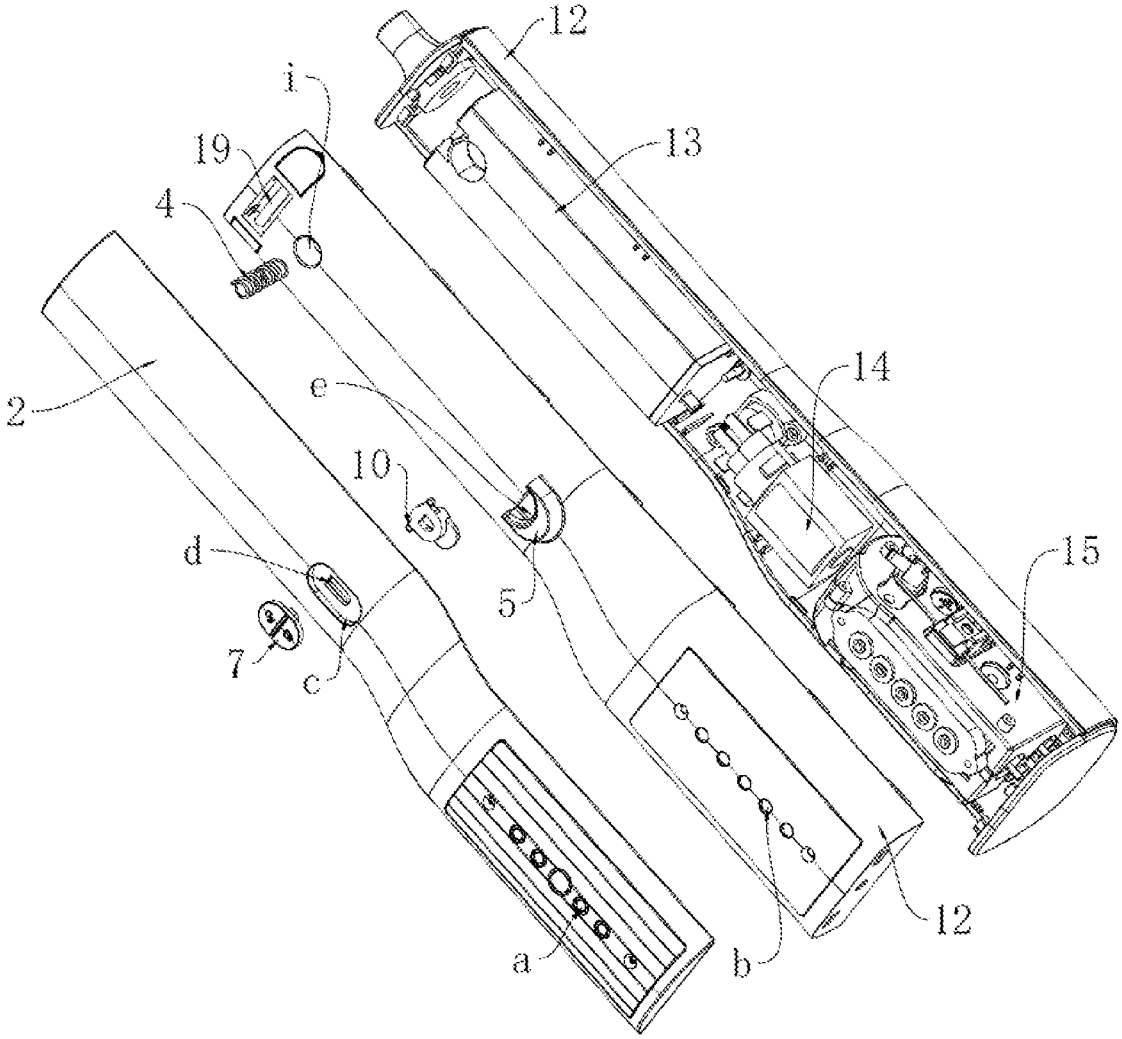
FIG. 5 shows the third explosion diagram of the present invention.

Preferably, in order to serve the basic functions of the garment steamer, as shown in FIGS. 2 and 5, the garment steamer body 1 includes: a casing 12, a water box 13, a water pump 14 and a heating element 15. The handhold part 16 and the ironing part 17 are both set on the casing 12, the heating element 15 is set in the ironing part 17 of the casing 12, and the steam outlet of the heating element 15 is connected to the steam holes b. The water box 13 is set in the handhold part 16 of the casing 12 and the water pump 14 is set in the casing 12 and between the water box 13 and heating element 15; The water pump 14 is connected to the water box 13 and heating element 15 respectively through a water tube. The water is drawn by water pump 14 from the water box 13 into the heating element 15 through the water tube, which can then be heated and vaporized by heating element 15 before being sprayed out through steam holes b and/or through holes a. A water inlet j connected to the water box 13 is set on the handhold part 16 of the casing 12. A control switch 18 is set on the garment steamer body 1 to control the start/stop of the steam spray from the garment steamer.

The above only aims to illustrate the technical scheme of the present invention without limitation. Any other modifications or equivalent replacements made by ordinary technicians in the art to the technical scheme of the present invention should be included in the scope of the claims of the present invention as long as they do not deviate from the technical scheme spirit and scope of the present invention.

The invention claimed is:

1. A garment steamer with a clamp, comprises a garment steamer body and a clamp; wherein the garment steamer body is provided with a handhold part and an ironing part; the ironing part is provided with several steam holes; one end of the clamp is hinged on one end of the handhold part away from the ironing part through a hinge shaft; and the clamp is provided with several through holes connected to the steam holes one by one; a locking structure with one part set on the handhold part and other part set on the clamp; an elastic member set between the clamp and garment steamer body and is used to separate the clamp from the garment steamer body to form an angle when the locking structure is in unlocked state; a first sliding slot is arranged on one side of the clamp near the garment steamer body; a second sliding slot is arranged on other side of the clamp away from the first sliding slot; a guide hole is set on the clamp that runs through the first sliding slot; the guide hole runs through the first sliding slot and second sliding slot.

2. The garment steamer with a clamp according to claim 1, wherein the locking structure comprises an insertion part that is protrusively set on the handhold part and can be inserted into the first sliding slot a side wall of the insertion part is provided with a snap-fit slot; a locking member is slidably fit in the first sliding slot and can be snap-fitted to or separated from the snap-fit slot; a toggle is connected to the locking member at one end and slides in the guide hole from the first sliding slot to second sliding slot.

3. The garment steamer with a clamp according to claim 2, wherein the locking member is provided with positioning protrusions on two sides of the bottom, and several positioning slots match the positioning protrusions are set at the bottom of the first sliding slot and on two sides of the guide hole.

4. The garment steamer with a clamp according to claim 1, wherein a first fit slot is set on one side of the clamp near the garment steamer body and between the hinge shaft and first sliding slot, and a second fit slot opposite to the first fit slot is set on the handhold part; the elastic member is fixed at one end in the first fit slot and at other end in the second fit slot and abuts against the top of the second fit slot.

5. The garment steamer with a clamp according to claim 4, wherein a fixing column is set in the first fit slot, the elastic member is a spring, and one end of the spring is fit outside the fixing column and fixedly connected to the fixing column.

6. The garment steamer with a clamp according to claim 2, wherein t a fixing hole is set at the bottom of the locking member, and the toggle includes: a toggle board that is slidably assembled in the second sliding slot, and a toggle column that is integrally set on the toggle board and provided with the guide hole and fixing hole at one end.

7. The garment steamer with a clamp according to claim 1, wherein the garment steamer body comprises a casing, a water box, a water pump and a heating element; the handhold part and the ironing part are both set on the casing, the heating element is set in the ironing part of the casing, and the steam outlet of the heating element is connected to the steam holes; the water box is set in the handhold part of the casing and the water pump is set in the casing and between the water box and heating element; the water pump is connected to the water box and heating element respectively through a water tube.

* * * * *